US005607382A

United States Patent [19]

Boriani et al.

[11] Patent Number: 5,607,382

[45] Date of Patent: Mar. 4, 1997

[54] FOLDER DEVICE

[75] Inventors: Silvano Boriani; Alessandro Minarelli, both of Bologna, Italy

[73] Assignee: G.D S.p.A., Bologna, Italy

[21] Appl. No.: 251,320

[22] Filed: May 31, 1994

[30] Foreign Application Priority Data

Jun. 1, 1993 [IT] Italy ..... BO93A0255

[51] Int. Cl.[6] ..... B65H 45/18

[52] U.S. Cl. ..... 493/182; 493/453; 493/457; 493/405

[58] Field of Search ..... 493/162, 178, 493/399, 400, 401, 405, 416, 417, 436, 437, 453, 457, 180, 182, 183

[56] References Cited

U.S. PATENT DOCUMENTS 4,188,024 2/1980 Seragnoli ..... 270/67

*Primary Examiner*—Joseph J. Hail, III

*Assistant Examiner*—Christopher W. Day

*Attorney, Agent, or Firm*—Cushman Darby & Cushman IP Group of Pillsbury Madison & Sutro LLP

[57] ABSTRACT

A device for folding flat die-cuts through 180° has a flipper of which the movement is guided by linkages composed of at least two rectilinear slots, occupying a common plane and compassing an acute angle, and at least two slides free to traverse along the two slots. The flipper is connected pivotably to the slides, and the folding action is generated by a single linear actuator stroking in a direction substantially parallel to one of the slots, its rod end being hinged to the respective slide.

6 Claims, 4 Drawing Sheets

FOLDER DEVICE

BACKGROUND OF THE INVENTION

The present invention relates to a folder device. In particular, the present invention relates to a device designed to fold one terminal portion of an elongated piece of sheet material through 180° in relation to the remainder of the piece.

The invention finds application to marked advantage in the art field of packaging generally, and in the field of packaging of commodities for smokers in particular; indeed reference is made specifically to this very application throughout the disclosure, albeit no limitation in general scope being implied.

In conventional packaging systems, the operation of bending one portion of a piece of sheet material through 180° would be effected by means of a unit comprising two distinct folders arranged in series, one of which would be a fixed folding element generally of helical geometry.

To the end of reducing the relatively cumbersome dimensions of such folding units, U.S. Pat. No. 4,188,024 discloses a device in which an elongated piece of material is bent through 180° by the action of a single folder provided in the form of a flat rod which is capable of movement generated along a predetermined operating trajectory by two distinct transmission linkages, of which the embodiment and control involve notable drawbacks in terms of construction and cost.

SUMMARY OF THE INVENTION

The object of the present invention is to provide a device for effecting a fold of 180° in an elongated piece of sheet material, from which the drawbacks mentioned above are absent.

The stated object is realized according to the present invention in a folder device which includes a flipper, and operating means by which the flipper is displaced along a predetermined fold trajectory. The operating means include actuator means by which a first point on the flipper is displaced along a first trajectory, and reaction means interacting with the flipper, by which the flipper is caused to rotate about a first axis passing through the first point as the first point is displaced along the first trajectory.

In a preferred embodiment of the folder device, the first trajectory is a rectilinear trajectory, and the reaction means advantageously comprise guide means coupled to a second point on the flipper and serving to displace the selfsame second point along a second trajectory, likewise rectilinear, extending at an angle other than zero in relation to the first trajectory.

Preferably, the actuator means include a first track extending along the first trajectory, also first coupling means by which the first point on the flipper is caused to traverse slidably along the first track and to rotate about the first axis, and a linear actuator by which the first point on the flipper is displaced along the first track. Again preferably, the guide means include a second track extending along the second trajectory, and second coupling means by which the second point on the flipper is caused to traverse slidably along the second track and to rotate about a second axis disposed parallel to the first axis and passing through the second point.

BRIEF DESCRIPTION OF THE DRAWINGS

The invention will now be described in detail, by way of example, with the aid of the accompanying drawings, in which.

DESCRIPTION OF THE PREFERRED EMBODIMENT

Figure 2:
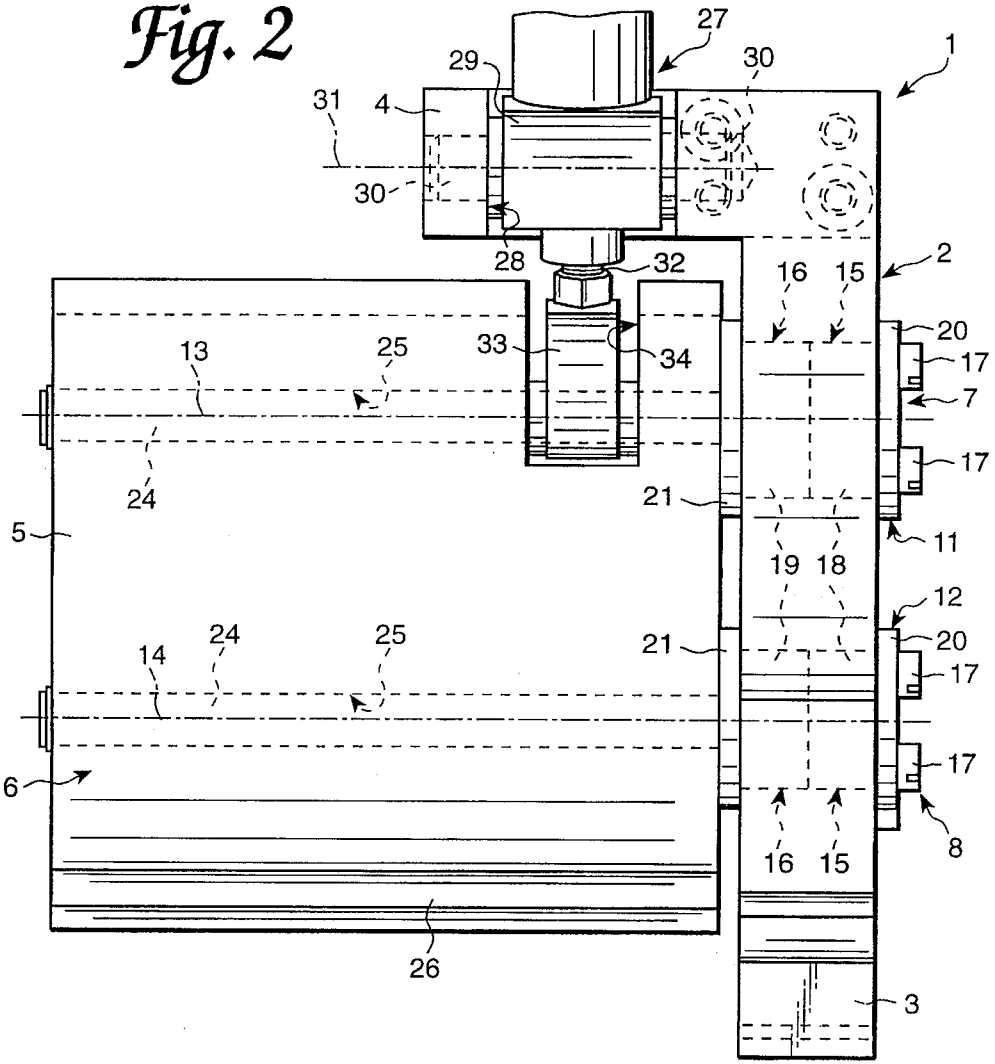
FIG. 2 is a further elevation of the device shown in FIG. 1.
Figure 1:
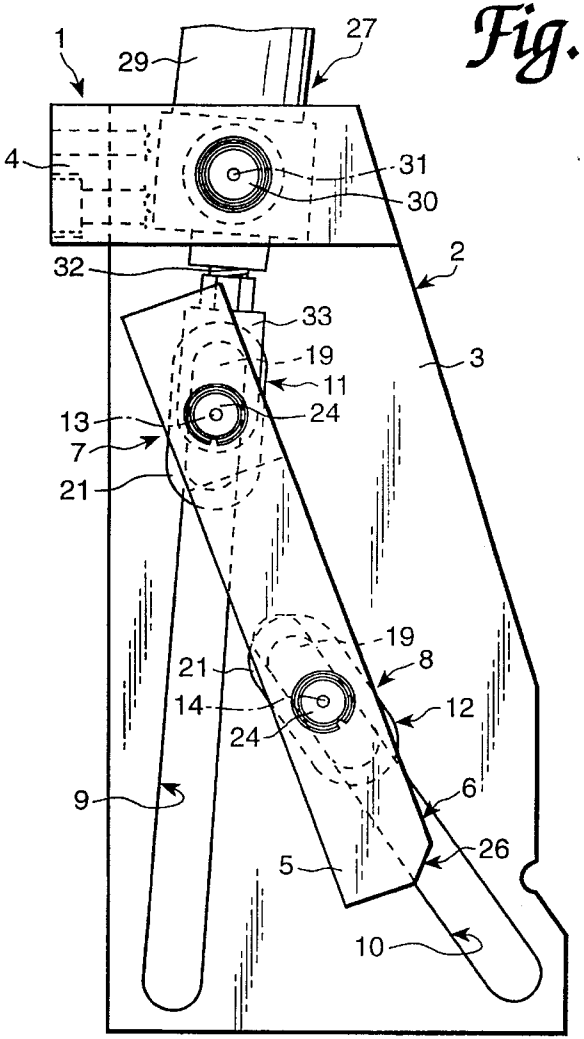
FIG. 1 shows a preferred embodiment of the folder device according to the present invention, seen in a side elevation.
Figure 3:
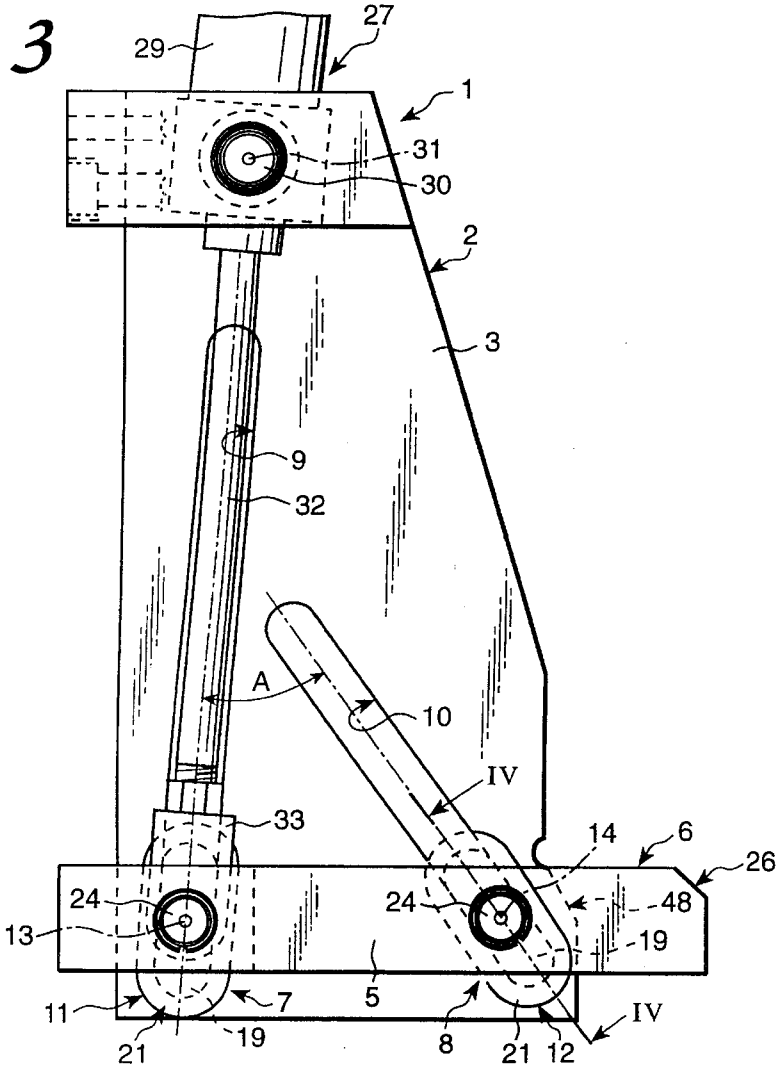
FIG. 3 is a view as in FIG. 1, showing the device in a different operating position.

In FIGS. 1, 2 and 3 of the drawings the numeral, 1 denotes a folder device comprising a fixed pedestal frame 2 of upturned "L" profile, composed of a pillar 3 and an arm 4, disposed at right angles one to another, also a flipper 5 of substantially rectangular shape providing a flat lateral working surface 6, which is cantilevered from the pillar 3 on the same side as the arm 4.

The flipper 5 is associated with the pillar 3 by way of slide-and-track guide means 7 and 8, each comprising a respective rectilinear slot 9 and 10 fashioned in the pillar 3 and providing the track part of such means. More exactly, the one slot 9 extends substantially the full length of the pillar 3 in a direction substantially perpendicular to the arm 4, whereas the remaining slot 10 occupies a terminal portion of the pillar 3, which is remote from the portion which is associated with the arm 4, disposed convergent with the first slot 9 and the arm 4 in such a way that the angle A compassed by the two slots 9 and 10 is an acute angle, preferably of the order of 50°.

The guide means 7 and 8 also comprise respective slides 11 and 12, each engaging in and thus capable of movement along the corresponding slot 9 and 10, which are connected to the flipper 5 in such a way as to allow their rotation about respective axes 13 and 14, which is disposed parallel one with another and with the flat working surface 6 of the flipper 5, and perpendicular to the pillar 3.

Figure 4:
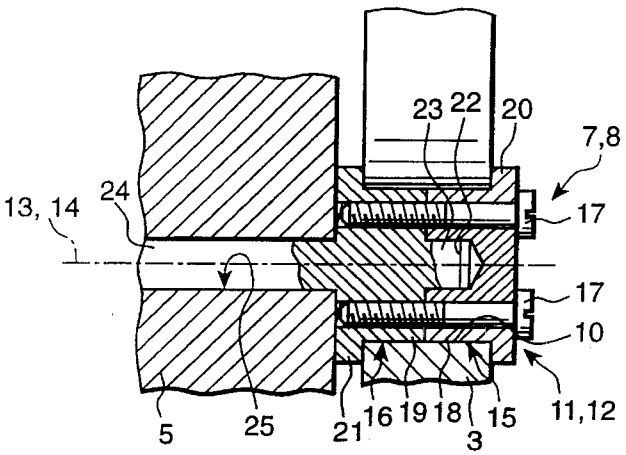
FIG. 4 is the section through IV—IV in FIG. 3.

Each slide 11 and 12 is composed of two blocks 15 and 16 aligned on the respective axis 13 and 14 and united by a respective pair of screws 17. The blocks 15 and 16 comprise respective portions 18 and 19 which are connected rigidly by the screws 17 and present respective flanges 20 and 21 by which the portions 18 and 19 are restrained axially within the respective slots 9 and 10. With reference also to FIG. 4, each block 16 is embodied with a blind hole 22 positioned to accept a first pin 23 issuing from one side of the associated block 15, which also provides a second pin 24 projecting from the opposite side and seated pivotably, restrained in the axial direction, within a respective through-hole 25 provided by the flipper 5 in a position of coaxial alignment with the corresponding axis 13 and 14 of rotation.

The flipper 5 provides a bevelled edge 26 which is contiguous to the flat lateral working surface 6 on the side farthest from the arm 4, which extends parallel to the two axes 13 and 14 of rotation.

The flipper 5 is supported by a linear actuator 27 and thus is capable of movement, brought about by the actuator 27, along a predetermined fold trajectory between a first limit position indicated in FIG. 1, in which the flipper 5 is disposed nearly perpendicular to the arm 4, and a second limit position in which the flipper 5 lies substantially parallel to and with the working surface 6 directed up toward the arm 4. When the flipper 5 is disposed in the first limit position, each slide 11 and 12 occupies a substantially terminal portion of the respective slot 9 and 10 at the end nearer the arm 4, with the slide 11 of the guide means denoted 7, in particular, impinging directly on the extremity of the respective slot adjacent to the arm 4. When the flipper 5 is in the second limit position, the two slides 11 and 12 occupy terminal portions of the slots 9 and 10 at the end remote from the arm 4, with the slide 12 of the guide means 8, in particular, impinging directly on the extremity of the respective slot 10 farthest from the arm 4. Again observing FIGS. 1 to 3, the linear actuator 27 passes through a slot 28 fashioned in the arm 4, and comprises a body section 29 of which a terminal portion is hinged to the arm 4 by way of a pair of trunnions 30, in such a way that the actuator 27 is pivotably associated with the frame 2, able to rock on an axis 31 disposed parallel to the axes 13 and 14 of rotation and at right angles to the body 29 itself. The rod 32 of the actuator 27 is hinged, in turn, to the second pin 24 of the nearer slide 11 by way of an end mounting 33, which is positioned internally of a recess 34 fashioned in the flipper 5 and bridged by the pin 24.

Figure 5:
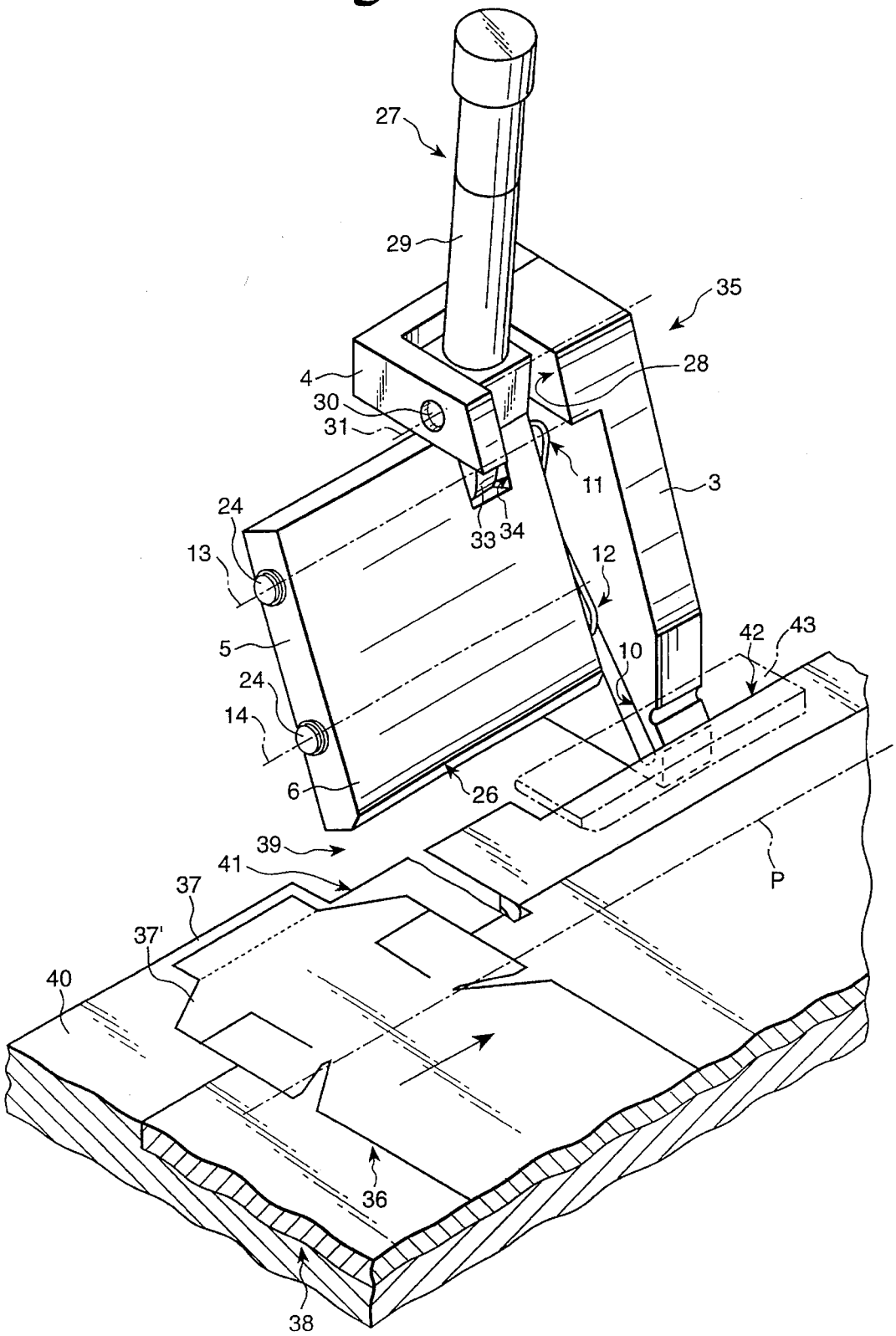
FIG. 5 is the perspective view of a folding unit incorporating the device of FIGS. 1 . . . 4.

FIG. 5 illustrates a folding unit 35, incorporating the folder device 1 described above, by which the end flap 37 of a die-cut sheet 36, e.g., of the type which is utilized to fashion a rigid packet (not illustrated) for cigarettes (likewise not illustrated), is bent through 180°. More exactly, the die-cut sheet 36 further comprises an intermediate panel 37', which is located adjacent to the end flap 37 and destined to provide the front face (not illustrated) of the hinged lid (not illustrated) upon completion of the packet (not illustrated). Thus, the flap 37 is rotated through 180° by the unit 35 and flattened against the intermediate panel 37' in such a manner as to create a reinforcement for the front face of the lid.

To this end, the unit 35 comprises a conveyor 38, in addition to the device 1 described above, on which die-cut sheets 36 advance singly and in succession along a predetermined feed path P that extends parallel with the axes 13 and 14 of the guide means and with the arm 4, passing through a station 39 at which each end flap 37 is folded over the corresponding intermediate panel 37'. The conveyor 38 comprises a fixed bed 40 extending parallel with the arm 4, by which the die-cut sheets 36 are supported slidably during their progress along the feed path P. The part of the bed 40 directed toward the device 1 exhibits a first lateral edge 41 occupying a first portion of the folding station 39, from which the end flap 37 of each successive die-cut sheet 36 will project when the unit is in operation. The part of the bed 40 that coincides with the pillar 3 is bounded by a second lateral edge 42, lying beyond the first edge 41 along the feed direction of the conveyor 38, which is recessed from the first edge 41 by a distance which is at least equal to the width of the flap 37 and extends beneath a plate 43 disposed parallel with and above the bed 40, separated from the conveying surface by a gap marginally greater than the thickness of the die-cut 36.

The operation of the unit 35 will now be described with reference, for the sake of simplicity, to just one die-cut sheet 36 advanced by the conveyor 38 along the feed path P and through the folding station 39, and departing from the configuration in which the flipper 5 is suspended from the linear actuator 27 in the first limit position. In this situation, the actuator 27 is extended to traverse the slides 11 and 12 along the respective slots 9 and 10, with the result that the one axis 13 is displaced along a predetermined trajectory, a rectilinear trajectory in the instance of the example illustrated, and the flipper 5 is made to rotate about the axis 13 by reason of the reaction force applied through the bounding surface of the slide denoted 12, of which the respective slot 10 functions as a reaction bearing.

Figure 6:
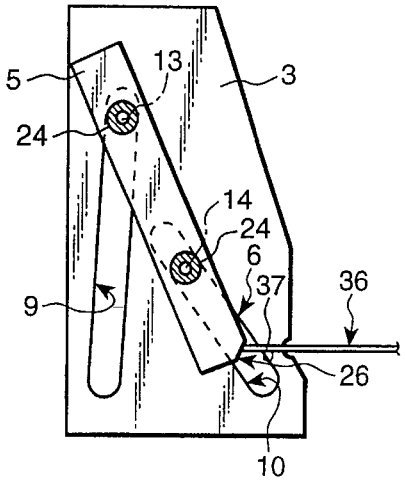
FIGS. 6 . . . 10 show the unit of FIG. 5 in a succession of different operating positions, shown on a smaller scale, and with certain parts omitted for clarity.
Figure 7:
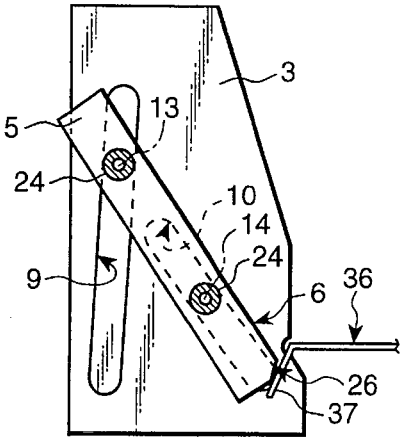
Figure 8:
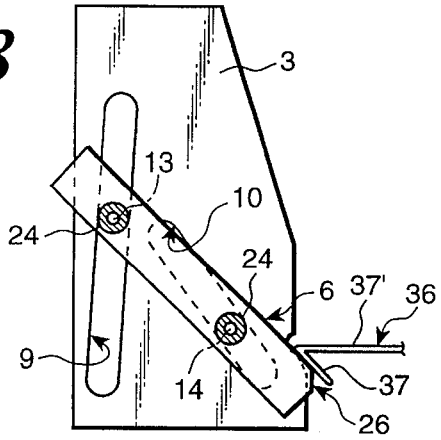
Figure 9:
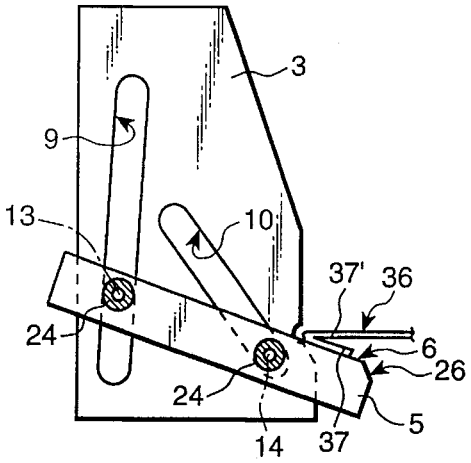
Figure 10:
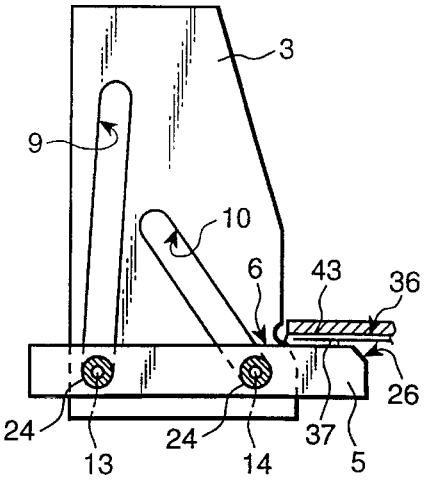

With the flipper 5 thus in motion, and a die-out sheet 36 entering the station 39 and passing over the first edge 41 of the bed 40, the bevelled edge 26 engages initially in contact with the outer edge of the end flap 37 (FIG. 6), then continues on its trajectory, impinging on and sliding across a middle portion of the flap 37 (FIG. 7) to the point of forcing a bend to be created, which is substantially square with the fixed bed 40. As the flipper 5 moves on, the flap 37 is engaged by the working surface 6 (FIG. 8) and forced progressively further toward the intermediate panel 37' (FIG. 9), to the point at which the two thicknesses 37 and 36 are finally flattened against one another (FIG. 10) and forced under the plate 43 to complete the 180° fold.

Thus, the operation of folding an elongated piece of material, and more exactly the end flap 37 of a die-cut sheet 36, is obtained in extremely simple fashion, by providing and making use of a flipper 5 capable of movement along two tracks, provided by respective slots 9 and 10, and utilizing a single linear actuator 27.

What is claimed is:

1. A device for folding an elongated piece of sheet material through 180°, comprising:

a flipper;

operating means by which a first point on the flipper is displaced along a first rectilinear trajectory on a first path;

reaction means by which the flipper is caused to rotate about a first axis passing through the first point in response to a displacement of the first point along the first trajectory and by which a second point of the flipper is displaced along a second rectilinear trajectory, the second trajectory being on a second path intersecting the first path at an angle other than zero;

said operating means and reaction means including a first track extending along the first trajectory, first coupling means by which the first point on the flipper is caused to traverse slidably along the first track and to rotate about the first axis, and an actuator by which the first point on the flipper is displaced along the first track.

2. A device for folding as in claim 1, said reaction means further including:

guide means comprising a second track extending along the second trajectory, and second coupling means by which the second point on the flipper is caused to traverse slidably along the second track and to rotate about a second axis disposed parallel to the first axis and passing through the second point.

3. A device for folding as in claim 2, wherein:

the first and second coupling means each comprise a respective slide capable of movement along the corresponding said track, and respective hinge means by which the flipper is coupled to the respective slide in such a way to allow rotation about the respective said axis.

4. A device for folding as in claim 3, wherein:

the tracks occupy a common plane.

5. A device for folding as in claim 4, further comprising:

a support pedestal having a pillar, the tracks being embodied as slots provided in the pillar.

6. A device for folding as in claim 5, wherein:

the flipper has a first and a second hole extending parallel to the first and second axes of rotation, and has hinge means which comprise pins which are associated rigidly with the respective said slides, positioned coaxially with the respective first and second axis, and seated pivotably in corresponding ones of said holes.

* * * * *